US012760933B2

(12) United States Patent
Kimura et al.

(10) Patent No.: US 12,760,933 B2
(45) Date of Patent: Oct. 13, 2026

(54) MULTIPLE HOT WATER SUPPLY SYSTEM

(71) Applicant: NORITZ CORPORATION, Hyogo (JP)

(72) Inventors: Yoshitaka Kimura, Hyogo (JP); Toshihiko Hamagami, Hyogo (JP); Hisataka Hayase, Hyogo (JP)

(73) Assignee: NORITZ CORPORATION, Hyogo (JP)

( * ) Notice: Subject to any disclaimer, the term of this patent is extended or adjusted under 35 U.S.C. 154(b) by 387 days.

(21) Appl. No.: 18/528,661

(22) Filed: Dec. 4, 2023

(65) Prior Publication Data

US 2024/0191908 A1 Jun. 13, 2024

(30) Foreign Application Priority Data

Dec. 9, 2022 (JP) ..... 2022-197358

(51) Int. Cl.
*F24H 15/172* (2022.01)
*F24H 15/414* (2022.01)

(52) U.S. Cl.
CPC ..... *F24H 15/172* (2022.01); *F24H 15/414* (2022.01)

(58) Field of Classification Search
None
See application file for complete search history.

(56) References Cited

U.S. PATENT DOCUMENTS 11,561,003 B2 * 1/2023 Carrasco ..... F22B 35/008
2004/0176858 A1 * 9/2004 Kuwahara ..... G05B 23/0235 700/275
2008/0022946 A1 * 1/2008 Inami ..... F24D 12/02 122/14.21
2010/0198417 A1 * 8/2010 Deivasigamani ..... F24H 15/31 700/282
2012/0138149 A1 * 6/2012 Hatada ..... F24H 9/2035 122/367.1
2012/0191256 A1 * 7/2012 Deivasigamani .. G05D 23/1932 700/276
2018/0252437 A1 * 9/2018 Okamoto ..... F24H 15/395
2020/0386416 A1 * 12/2020 Manay ..... F24D 17/0078
2022/0065486 A1 * 3/2022 Thurlkill ..... G05B 19/042
2022/0121229 A1 * 4/2022 Hobbs ..... G05D 23/1353
2022/0228766 A1 * 7/2022 Nakahara ..... F25B 49/02

FOREIGN PATENT DOCUMENTS

CN 114233614 A * 3/2022 ..... F04B 49/06
JP H10300076 11/1998
JP 2020016409 1/2020

* cited by examiner

*Primary Examiner* — Howard Cortes
(74) *Attorney, Agent, or Firm* — JCIPRNET

(57) ABSTRACT

In a multiple hot water supply system (10) including: multiple hot water supply device (11 to 14); and a control device (15) increasing/decreasing an operating device number of a hot water supply operation performed by the hot water supply devices (11 to 14) according to a demanded hot water supply capacity, the control device (15) includes a function of calculating a continuous standby time of each hot water supply device (11 to 14), and, when there is a hot water supply device whose continuous standby time exceeds a reference standby time set in advance, exerts control so that the hot water supply device most preferentially supplies hot water during a next hot water supply operation.

3 Claims, 5 Drawing Sheets

MULTIPLE HOT WATER SUPPLY SYSTEM

CROSS-REFERENCE TO RELATED APPLICATION

This application claims the priority benefit of Japan application no. 2022-197358, filed on Dec. 9, 2022. The entirety of the above-mentioned patent application is hereby incorporated by reference herein and made a part of this specification.

BACKGROUND

Technical Field

The invention relates to a multiple hot water supply system having a control device that increases or decreases the device number in a hot water supply operation performed by multiple hot water supply devices in accordance with a demanded hot water capacity.

Description of Related Art

Conventionally, combustion-type hot water supply devices that supply hot water heated by using the combustion heat of fuel gas have been widely used. As disclosed in Patent Document 1, for example, the supply part of the fuel gas of such hot water supply device includes: a proportional solenoid valve that changes a supply flow rate of the fuel gas; a primary solenoid valve that switches between supply and stoppage of the fuel gas to the proportional solenoid valve; and a main solenoid valve that switches between supply and stoppage of the fuel gas from the proportional solenoid valve to a burner.

In general, when a solenoid valve stays closed for a long time, there is a concern that the valve body for blocking the flow passage may become fixed and unable to open. Therefore, Patent Document 1 discloses an operation that the proportional solenoid valve is temporarily set to the maximum opening degree to remove the fixation at the time when the combustion starts (at the time of cold start) after standby for a predetermined time.

Meanwhile, in facilities such as public baths or factories, which may consume a large amount of hot water at once, a multiple hot water supply system formed by connecting in series multiple combustion-type hot water supply devices has been used widely. In such multiple hot water supply system, one of the hot water supply devices is set in advance as the main hot water supply device, and the hot water heated by the main hot water supply device is firstly supplied when a hot water supply operation starts. In addition, in the case where the demanded hot water supply capacity cannot be coped with by using only the main hot water supply device, the activated device number is increased, and hot water is also supplied from auxiliary hot water supply devices together with the main hot water supply device.

Since the main hot water supply device necessarily supplies hot water during the hot water supply operation, in the multiple hot water supply system of Patent Document 2, for example, the hot water supply device serving as the main hot water supply device is changed in order through rotation control, and the activation time of the hot water supply devices serving as the main hot water supply device is equalized.

PRIOR ART DOCUMENT(S)

Patent Document(s)

Patent Document 1: Japanese Laid-open No. H10-300076
Patent Document 2: Japanese Laid-open No. 2020-16409

The auxiliary hot water supply devices of the multiple hot water supply system of Patent Document 2 standby for a long time in the case where the hot water supply amount is low. In particular, the later an auxiliary hot water supply device starts to supply hot water, the less chance this hot water supply device has to be activated. Therefore, there is a chance that the gas solenoid valve of the fuel gas supply part that is standby becomes fixed in the closed state, and there is a concern that combustion cannot be carried out when the chance of activation comes.

In Patent Document 1, when combustion starts after standby for a predetermined time, a fixation removal operation is performed to set the proportional solenoid valve changing the flow rate of the fuel gas to the maximum opening degree. However, in the case where fixation cannot be removed, combustion cannot be started, and the fixation of the primary solenoid valve and the main solenoid valve cannot be coped with. Therefore, a technique is needed for preventing the gas solenoid valves equipped in the fuel gas supply part of the hot water supply device from being fixed.

Therefore, to the invention provides a multiple hot water supply system capable of preventing the solenoid valves equipped in the fuel gas supply part of the hot water supply device from being fixed.

SUMMARY

An aspect of the invention provides a multiple hot water supply system. The multiple hot water supply system includes multiple hot water supply devices; and a control device that increases or decreases an operating device number of a hot water supply operation performed by the hot water supply devices in accordance with a demanded hot water supply capacity. In the multiple hot water supply system, the control device includes a function of calculating a continuous standby time of each of the hot water supply devices, and, in a case where there is a hot water supply device whose continuous standby time exceeds a reference standby time set in advance, the control device exerts control so that the hot water supply device most preferentially supplies hot water during a next hot water supply operation.

DESCRIPTION OF THE EMBODIMENTS

Figure 1:
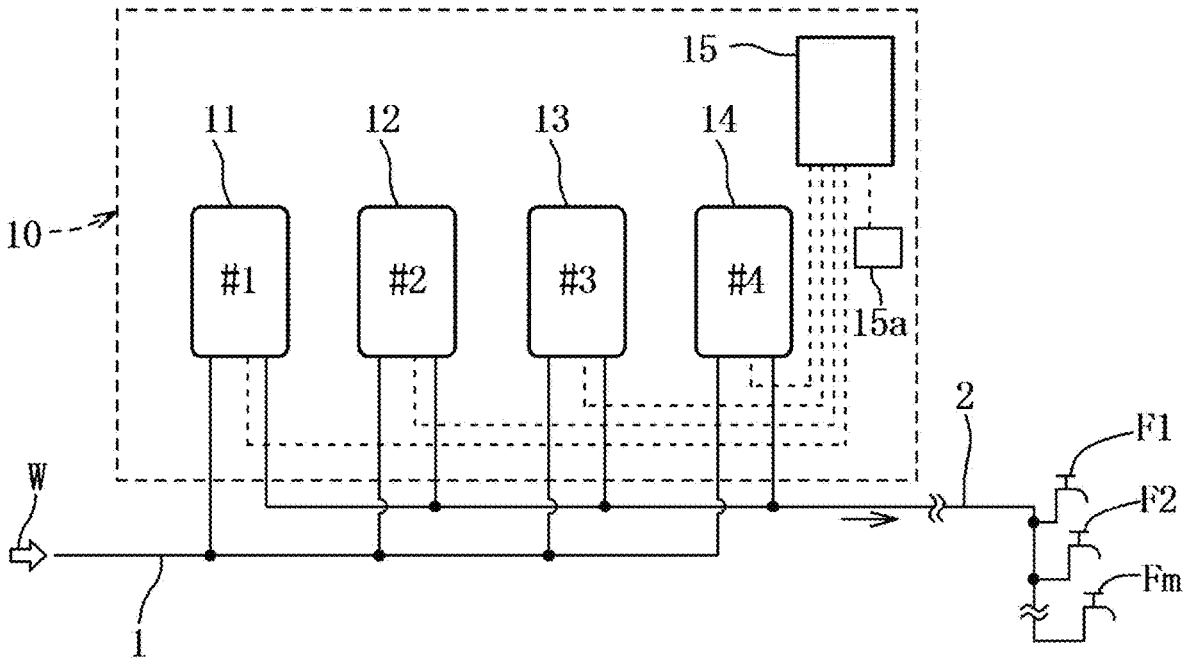
FIG. 1 is a schematic diagram illustrating a multiple hot water supply system according to Embodiment 1 of the invention.

An aspect of the invention provides a multiple hot water supply system. The multiple hot water supply system includes multiple hot water supply devices; and a control device that increases or decreases an operating device number of a hot water supply operation performed by the hot water supply devices in accordance with a demanded hot water supply capacity. In the multiple hot water supply system, the control device includes a function of calculating a continuous standby time of each of the hot water supply devices, and, in a case where there is a hot water supply device whose continuous standby time exceeds a reference standby time set in advance, the control device exerts control so that the hot water supply device most preferentially supplies hot water during a next hot water supply operation.

According to the configuration, the hot water supply device whose continuous standby time exceeds the reference standby time set in advance can necessarily supply hot water at the time of the next hot water supply operation. Accordingly, at the time of the next hot water supply operation, the gas solenoid valves of the hot water supply device having been on standby over the reference standby time can be driven before being fixed, and the gas solenoid valves can be prevented from being fixed.

According to an embodiment of the multiple hot water supply system, in the multiple hot water supply system, in a case where there are a plurality of hot water supply devices whose continuous standby time exceeds the reference standby time, the control device exerts control so that a hot water supply device having a longest continuous standby time most preferentially supplies hot water during the next hot water supply operation.

According to the configuration, the hot water supply device whose continuous standby time is the longest among the hot water supply devices whose continuous standby time exceeds the reference standby time set in advance can necessarily supply hot water at the time of the next hot water supply operation. Accordingly, at the time of the next hot water supply operation, the gas solenoid valves of the hot water supply device having the longest continuous standby time can be driven before being fixed, and the gas solenoid valves can be prevented from being fixed.

According to an embodiment of the multiple hot water supply system, in the multiple hot water supply system, the control device includes a function of calculating a cumulative hot water supply operation time of each of the hot water supply devices, and, in a case where there is no hot water supply device whose continuous standby time exceeds the reference standby time, the control device exerts control so that a hot water supply device whose cumulative hot water supply operation time is shortest most preferentially supplies hot water during the next hot water supply operation.

According to the above, in the case where there is no hot water supply device whose continuous standby time exceeds the reference standby time, the hot water supply device whose cumulative hot water supply operation time is the shortest necessarily supplies hot water during the next hot water supply operation. Accordingly, the difference in cumulative hot water supply operation time among the hot water supply devices can be reduced, and the progress of wear and deterioration of the hot water supply devices can be equalized.

According to the multiple hot water supply system of the invention, the solenoid valves equipped in the fuel gas supply part of the hot water supply device can be prevented from being fixed.

In the following, the aspects for implementing the invention will be described based on the embodiments.

Embodiment 1

As shown in FIG. 1, municipal water as indicated by an arrow sign W is supplied to a water supply pipe 1, and a multiple hot water supply system 10 is connected, so that the municipal water guided into the water supply pipe 1 is heated to a target temperature and supplied to a hot water supply pipe 2 equipped with multiple hot water supply faucets F1 to Fm as hot water supply destinations, for example. The multiple hot water supply system 10 has multiple (four herein) hot water supply devices 11 to 14 and a system control device 15 (control device) for controlling the operating device number of a hot water supply operation performed by the hot water supply devices 11 to 14. The hot water supply devices 11 to 14 are numbered with #1 to #4, for example.

The system control device 15 has an operation terminal 15*a* for performing a setting operation for a tapping temperature, for example, of the multiple hot water supply system 10. The hot water supply devices 11 to 14 are connected in parallel between the water supply pipe 1 and the hot water supply pipe 2, and hot water can be supplied to the hot water supply faucets F1 to Fm from any of the hot water supply devices 11 to 14. The hot water supply faucets F1 to Fm, for example, have a function of mixing municipal water to adjust temperature, and a hot water supply user may make adjustment to a desired temperature. It is noted that the number of hot water supply devices forming the multiple hot water supply system 10 is not limited to four, and may be two or more.

Figure 2:
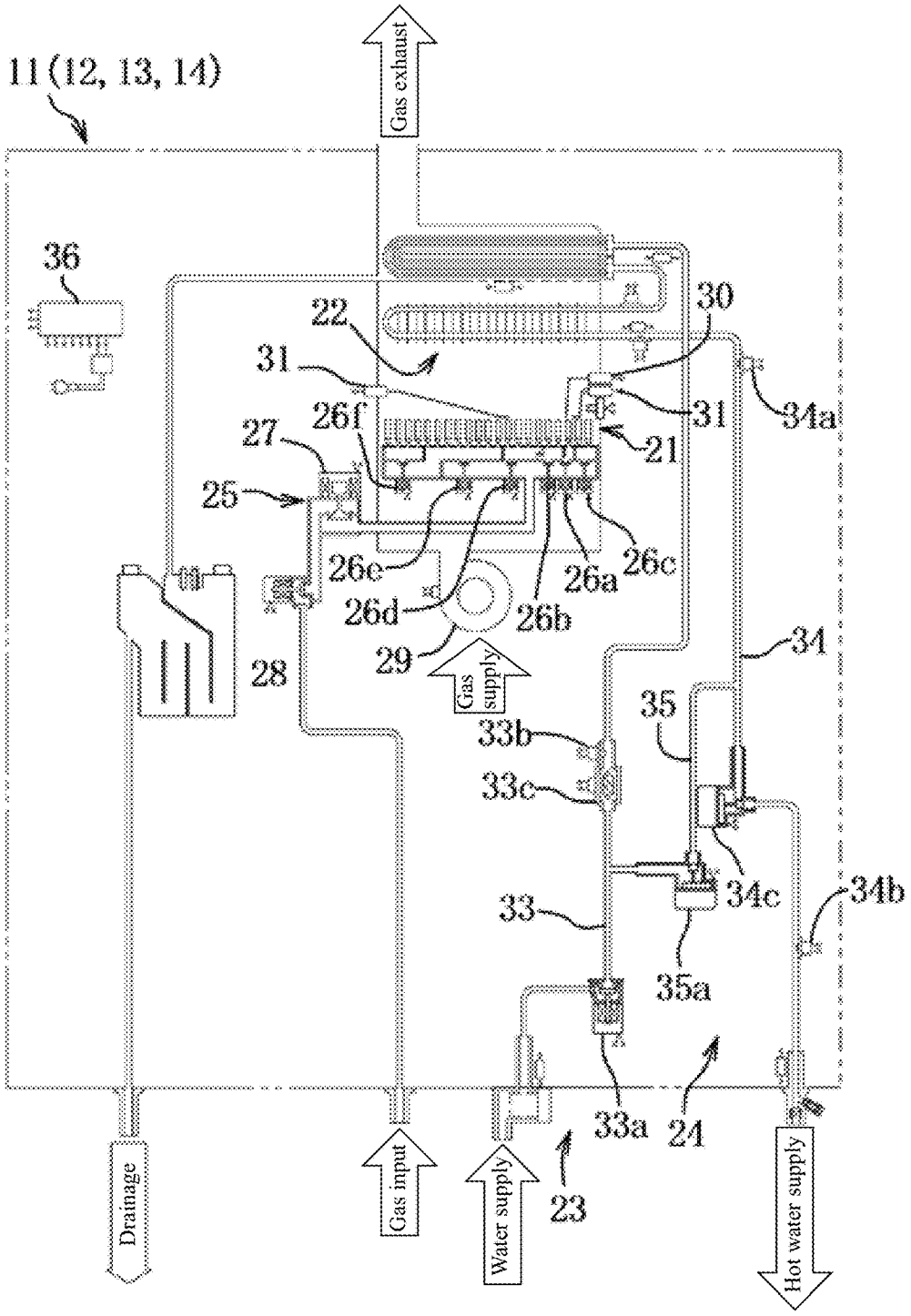
FIG. 2 is a schematic view illustrating a hot water supply device forming the multiple hot water supply system according to Embodiment 1.

In the following, the hot water supply devices 11 to 14 will be described. However, since the hot water supply devices 11 to 14 have the same configuration, the hot water supply device 11 will be described, whereas the description of the hot water supply devices 12 to 14 will be omitted. As shown in FIG. 2, the hot water supply device 11 is a combustion-type hot water supply device, and is configured to utilize the combustion heat of the fuel gas in the combustion part 21 and perform a heating operation that heats the hot water flowing through a heat exchange part 22, thereby supplying hot water. The hot water supply device 11 has a water supply part 23 supplying municipal water to the heat exchange part 22 and a tapping part 24 adjusting the temperature of the hot water heated by the heat exchange part 22 to tap hot water.

The combustion part 21 has multiple combustion sections and is herein divided into six combustion sections. Fuel gas is supplied from a fuel gas supply part 25 to the combustion part 21. The fuel gas supply part 25 has, as gas solenoid valves, capacity switching solenoid valves 26*a* to 26*f* for switching between supply and stoppage of fuel gas for each combustion section; a gas flow rate adjustment solenoid valve 27 adjusting the supply flow rate of the fuel gas to the capacity switching solenoid valves 26*a* to 26*f*; and a primary solenoid valve 28 for switching between supply and stoppage of the fuel gas to the gas flow rate adjustment solenoid valve 27. In addition, a combustion fan 29, an ignition device 30, and a flame detection device 31 are equipped. The combustion fan 29 supplies air for combustion to the combustion part 21. The ignition device 30 ignites the combustion part 21 by using electric discharge. The flame detection device 31 detects flame of the combustion part 21.

The water supply part 23 has a water supply passage 33, a water supply valve 33*a*, a water supply temperature sensor 33*b*, and a water supply flow rate sensor 33*c*. The water supply passage 33 connects the water supply pipe 1 and the heat exchange part 22. The water supply valve 33*a* opens and closes the water supply passage 33. The water supply temperature sensor 33*b* detects the temperature (water supply temperature) of the municipal water flowing into the water supply passage 33. The water supply flow rate sensor 33*c* detects the flow rate (water supply flow rate) of the municipal water supplied to the heat exchange part 22.

The tapping part 24 has a tapping passage 34 and a bypass passage 35. The tapping passage 34 connects the heat exchange part 22 and the hot water supply pipe 2. The bypass passage 35 is branched from the water supply passage 33 on the downstream side of the water supply valve 33*a* and connected with the tapping passage 34. The bypass passage 35 is equipped with a bypass flow rate adjustment valve 35*a* adjusting the flow rate of the municipal water flowing in from the water supply passage 33.

The tapping passage 34 is equipped with a first tapping temperature sensor 34*a*, a second tapping temperature sensor 34*b*, and a tapping flow rate adjustment valve 34*c*. The first tapping temperature sensor 34*a* detects the temperature of the hot water heated by the heat exchange part 22. The second tapping temperature sensor 34*b* detects the temperature (tapping temperature) of the hot water in which the heated hot water is mixed with the municipal water from the bypass passage 35 and the temperature is adjusted. The tapping flow rate adjustment valve 34*c* adjusts the flow rate of the municipal water guided in from the water supply pipe 1 by adjusting the tapping flow rate of the hot water supplied to the hot water supply pipe 2.

The hot water supply device 11 has a control part 36 that cooperates with the system control device 15 to control the heating operation of the hot water supply device 11. The control part 36 acquires the detected flow rate of the water supply flow rate sensor 33*c* and the respective detected temperatures of the water supply temperature sensor 33*b* and the first and second tapping temperature sensors 34*a* and 34*b*. In addition, based on the detected flow rate and the detected temperature, the heating capacity is adjusted through the rotation speed control of the combustion fan 29, the opening degree control of the gas flow rate adjustment solenoid valve 27, and the opening/closing control of the capacity switching solenoid valves 26*a* to 26*d*, and the opening degree of the bypass flow rate adjustment valve 35*a* is adjusted. Accordingly, the hot water at the set target temperature is tapped to the hot water supply pipe 2 to supply hot water to the hot water supply destination.

For example, in the case where the hot water at the target temperature cannot be supplied due to a high hot water usage amount, the control part 36 exerts control to be able to supply hot water at the target temperature by adjusting the opening degree of the tapping flow rate adjustment valve 34*c* and lowering the water passing amount. The water passing amount of the hot water supply device 11 is calculated by the control part 36 based on the detected flow rate of the water supply flow rate sensor 33*c*, the opening degree of the bypass flow rate adjustment valve 35*a*, and the opening degree of the tapping flow rate adjustment valve 34*c*.

Then, the system control device 15 is described.

The system control device 15 sets one (e.g., the hot water supply device 11) of the hot water supply devices 11 to 14, which are the activation candidates of the hot water supply operation, as the main hot water supply device, and sets hot water supply devices (e.g., the hot water supply devices 12 to 14) other than the main hot water supply device 11 as auxiliary hot water supply devices.

The main hot water supply device is a hot water supply device that firstly starts the heating operation and supplies hot water at the time when the hot water supply operation starts. The auxiliary hot water supply device is a hot water supply device that is not activated when the hot water supply operation starts, but is additionally activated in accordance with the hot water supply capacity as required during the hot water supply operation. At the time of setting the auxiliary hot water supply devices, the order (activation priority) of additional activation of the auxiliary hot water supply devices are set from the first auxiliary hot water supply device, which is activated next to the main hot water supply device, then the second auxiliary hot water supply device, which is activated next, and then the third auxiliary hot water supply device activated last.

The system control device 15 sets open the water supply valve 33*a* with respect to the main hot water supply device, and sets the opening degree of the tapping flow rate adjustment valve 34*c* to a predetermined opening degree (e.g., fully open). In addition, the system control device 15 sets closed the water supply valve 33*a* with respect to the auxiliary hot water supply device, and sets the tapping flow rate adjustment valve 34*c* to a predetermined opening degree (e.g., half open). When the use of hot water supply at the hot water supply destination starts and the water supply flow rate of the main hot water supply device reaches or exceeds a predetermined activation start flow rate, the heating operation of the main hot water supply device is started, and the hot water supply operation of only the main hot water supply device is started.

In the case where the heating capacity of the hot water supply device starting the heating operation last reaches or exceeds a predetermined capacity set in advance, for example, the additional activation condition is met, and there is still an auxiliary hot water supply device not activated in the activation candidates, in order for the auxiliary hot water supply device that is not activated and has the highest activation priority among the activation candidates to be additionally activated, the system control device 15 opens the water supply valve 33*a* of such auxiliary hot water supply device. Since the municipal water guided into the water supply pipe 1 is distributed to the hot water supply device that is supplying hot water and the auxiliary hot water supply device that is additionally activated, the system control device 15, for example, adjusts the opening degree of the tapping flow rate adjustment valve 34*c* of the hot water supply device that is additionally activated last, so as to maintain the heating capacity of the hot water supply device that is activated earlier. It is noted that the heating capacities of the activated hot water supply devices, including the hot water supply device that is activated last, may be equalized.

In the case where the heating capacity of the additionally activated auxiliary hot water supply device reaches or exceeds the predetermined capacity, the additional activation condition is met, and there is still an auxiliary hot water supply device that is not activated in the activation candidates, the system control device 15 additionally activates another auxiliary hot water supply device that is not activated. In this way, the system control device 15 additionally activates each device in the case where the additional activation condition for the hot water supply device that is additionally activated last among the activated hot water supply devices is met and there is still an auxiliary hot water supply device that is additionally activatable, thereby increasing the operating device number in accordance with the demanded hot water supply capacity.

Meanwhile, in the case where the hot water usage amount decreases and the opening degree of the tapping flow rate adjustment valve 34*c* of the auxiliary hot water supply device activated last decreases, such as the case where the heating capacity is less than the minimum capacity and the activation stoppage condition is met, the system control device 15 closes the water supply valve 33*a* of the auxiliary hot water supply device activated last and stops the heating operation. When the operating device number decreases in accordance with the demanded hot water supply capacity, there is no activated auxiliary hot water supply device, and the water supply flow rate of the main hot water supply device is less than the lowest activation flow rate, the heating operation of the main hot water supply device is stopped, and the hot water supply operation performed by the multiple hot water supply system 10 ends.

According to the above, the system control device 15 performs operating device number control that increases or decreases the operating device number in accordance with the demanded hot water supply capacity. Therefore, in the hot water supply operation, the lower the activation priority of an auxiliary hot water supply device, the less chance this hot water supply device has to supply hot water. Even if there is a chance to supply hot water, the time for the heating operation is short. Therefore, the lower the activation priority of a hot water supply device, the longer the time (continuous standby time) during which the standby state continues.

The hot water supply device in the standby state closes the gas solenoid valves (i.e., the capacity switching solenoid valves 26*a* to 26*f*, the gas flow rate adjustment solenoid valve 27, the primary gas solenoid valve 28) of the fuel gas supply part 25, so that fuel gas does not flow out. Therefore, when the continuous standby time increases, the solenoid valves may be fixed in the closed state. Such fixation may be caused by, for example, oil or flux that adheres during manufacture or combustion products that are attached, regardless of the materials of the valve body and the seat part.

Therefore, the system control device 15 exerts control for preventing the gas solenoid valves of the fuel gas supply part 25 from being fixed based on the continuous standby time and the cumulative hot water supply operation time in the hot water supply operation control. The system control device 15 has the function of timing the continuous standby time and the cumulative hot water supply operation time of each of the hot water supply devices 11 to 14.

In the following, the hot water supply operation control of the system control device 15 is described based on the flowchart of FIG. 3. In the drawings, Si (i=1, 2, . . . ) refers to steps. The system control device 15 starts the hot water supply operation control when the multiple hot water supply system 10 is started, and when the hot water supply operation ends to end the hot water supply operation control, the system control device 15 starts the hot water supply operation control from the beginning again. When the hot water supply operation control starts, in S1, whether the main hot water supply device and the auxiliary hot water supply devices are set is determined. For example, in the case where the determination of S1 is No in the initial hot water supply operation, the flow proceeds to S2, the main hot water supply device and the auxiliary hot water supply devices are set in S2, and the flow proceeds to S3. In the initial hot water supply operation of the multiple hot water supply system 10, for example, the hot water supply device whose assigned number is #1 is the main hot water supply device, and the hot water supply devices of #2 to #4 are set as auxiliary hot water supply devices whose activation priorities are high according to the order of the numbers. In the case where the determination of S1 is Yes, the flow proceeds to S3.

In S3, whether the hot water supply operation is started is determined. In the case where the determination of S3 is No, the flow returns to S3, and the determination of S3 repeats until the determination of S3 is Yes. During the time of repeating the determination of S3, the continuous standby time of each of the main and auxiliary hot water supply devices is timed. In the case where the start information of the heating operation is received from the control part 36 of the main hot water supply device, for example, and the determination of S3 is Yes, the flow proceeds to S4. Since the hot water supply operation is started, in such hot water supply operation, the cumulative hot water supply operation time of the main hot water supply device as well as the cumulative hot water supply operation time of each auxiliary hot water supply device that is additionally activated are timed. In addition, the continuous standby time of the main hot water supply device and the continuous standby time of the auxiliary hot water supply device that is activated are respectively reset to zero.

In S4, whether there is a hot water supply device whose continuous standby time exceeds the first reference time is determined. The first reference time is selected from time determined in advance, such as 24 hours, 12 hours, 8 hours. In the case where the determination of S4 is Yes, the flow proceeds to S5. In S5, the fixation prevention operation of the gas solenoid valves in the hot water supply device whose continuous standby time exceeds the first reference time is executed, and the flow proceeds to S6. In S6, the continuous standby time of the hot water supply device having performed the fixation prevention operation is reset to zero, and the flow proceeds to S7. Meanwhile, in the case where the determination of S4 is No, the flow proceeds to S7.

Figure 4:
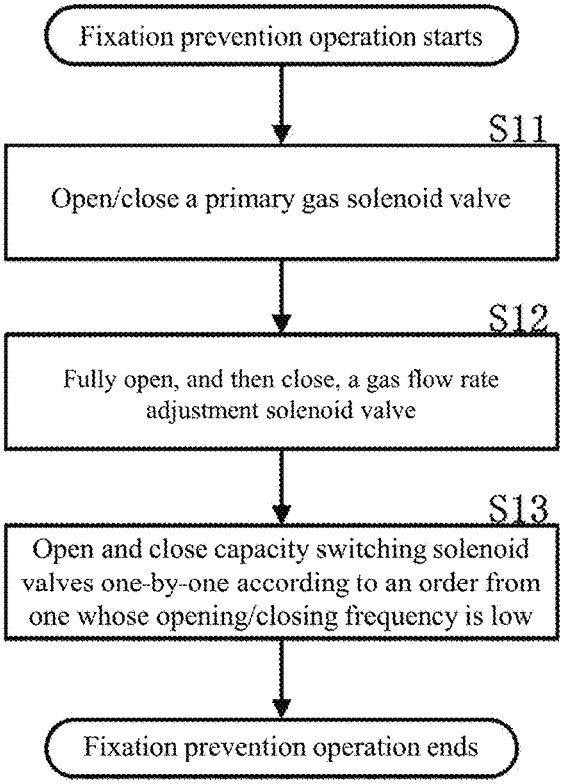
FIG. 4 is a flowchart for a fixation prevention operation according to Embodiment 1.

In the fixation prevention operation, as shown in FIG. 4, for example, the primary gas solenoid valve 28 is opened and closed in S11 and the flow proceeds to S12. Then, in S12, the gas flow rate adjustment solenoid vale 27 is fully opened and then fully closed, and then the flow proceeds to S13. Then, in S13, the capacity switching solenoid valves 26*a* to 26*f* are opened and closed in order from one whose opening/closing frequency is low, and the fixation prevention operation ends. Since the fixation prevention operation is performed during the hot water supply operation, the driving sounds of the gas solenoid valves should not be mistaken for an erroneous operation or a failure.

In the auxiliary hot water supply device which is not activated and in which the fixation prevention operation is performed, the continuous standby time is reset to zero, and the timing of the continuous standby time starts. In the auxiliary hot water supply device which is not activated and in which the fixation prevention operation is not performed, either, the timing of the continuous standby time continues. In the auxiliary hot water supply device that is additionally activated during the fixation prevention operation, in order to preferentially supply hot water, the fixation prevention operation is ended to perform the heating operation, the continuous standby time is reset to zero, and the cumulative hot water supply operation time is timed.

Figure 3:
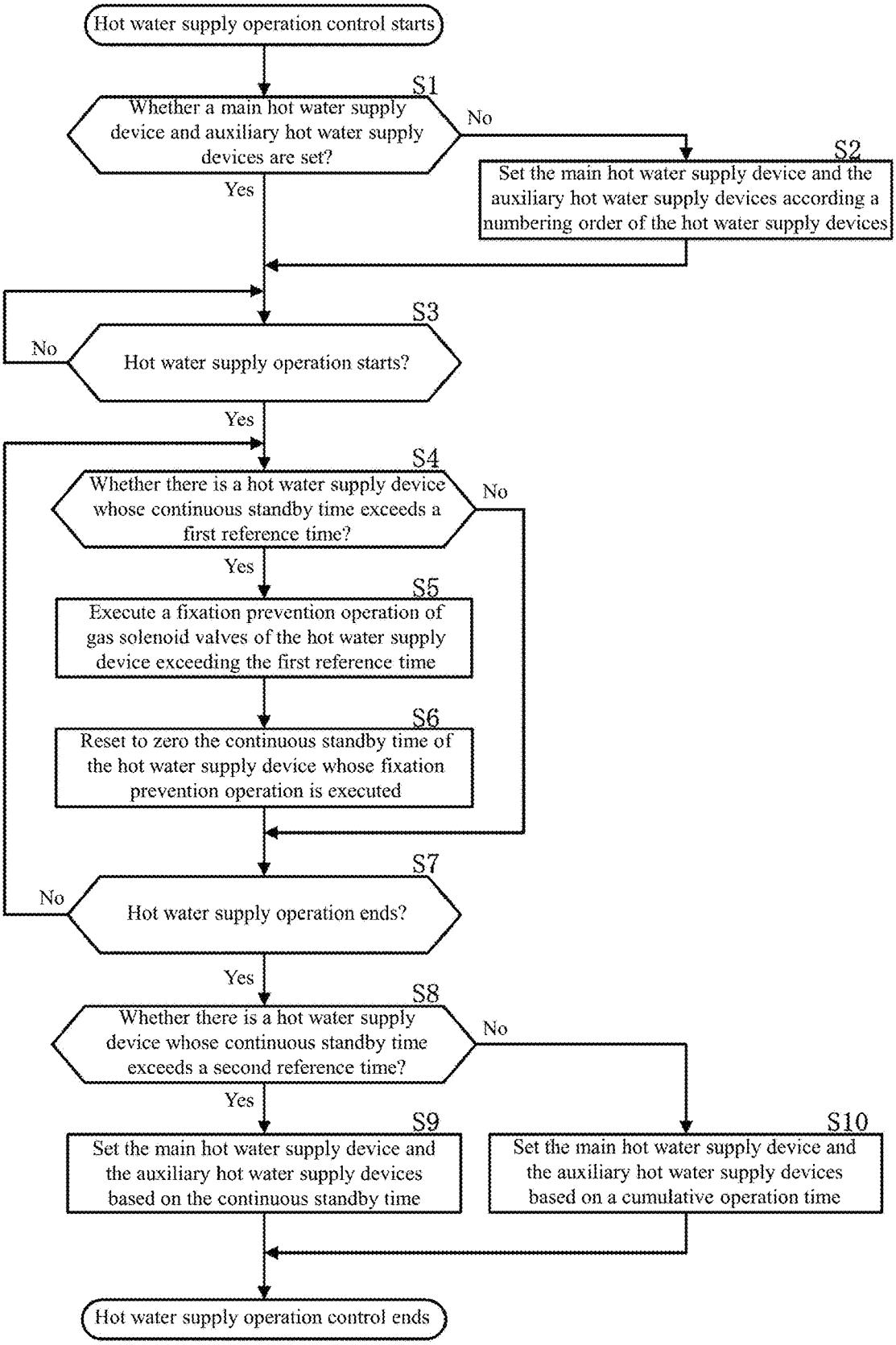
FIG. 3 is a flowchart for hot water supply operation control according to Embodiment 1.

Then, in S7 of FIG. 3, whether the hot water supply operation ends is determined. In the case where, for example, the stoppage of the heating operation is received from the control part 36 of the main hot water supply device, the hot water supply operation ends. In the case where the determination of S7 is No, the flow returns to S4 to continue the hot water supply operation. In the case where the determination of S7 is Yes, the flow proceeds to S8.

In S8, whether there is a hot water supply device whose continuous standby time exceeds the second reference time (reference standby time) is determined. The second reference time is set to be less than or equal to the first reference time, such as being set to ½ of the duration of the first reference time.

In the case where the determination of S8 is Yes, the flow proceeds to S9. In S9, the main hot water supply device and the auxiliary hot water supply devices at the time of the next hot water supply operation are set based on the continuous standby time, the hot water supply operation control ends, and the hot water supply operation control for the next hot water supply operation starts. At this time, the hot water supply device whose continuous standby time exceeds the second reference time is set as the main hot water supply device. In the case where there are multiple hot water supply devices whose continuous standby time exceeds the second reference time, the hot water supply device whose continuous standby time is the longest is set as the main hot water supply device in the next hot water supply operation. The hot water supply devices other than the main hot water supply device are set as the auxiliary hot water supply devices to which activation priorities are assigned so that, for example, the longer the continuous standby time of a hot water supply device, the more preferentially the hot water supply device supplies hot water.

Meanwhile, in the case where the determination of S8 is No, the flow proceeds to S10. In S10, the main hot water supply device and the auxiliary hot water supply devices are set based on the cumulative hot water supply operation time, the hot water supply operation control ends, and the hot water supply operation control for the next hot water supply operation starts. At this time, the hot water supply device whose cumulative hot water supply operation time is the shortest is set as the main hot water supply device in the next hot water supply operation. The hot water supply devices other than the main hot water supply device are set as the auxiliary hot water supply devices to which activation priorities are assigned so that, for example, the shorter the cumulative hot water supply operation time of a hot water supply device, the more preferentially the hot water supply device supplies hot water, and the cumulative hot water supply operation time is equalized. It is noted that, in order to prevent fixation, the activation priorities may be assigned among the auxiliary hot water supply devices, so that the longer the continuous standby time of a hot water supply device, the more preferentially the hot water supply device supplies hot water.

In the case where there is one hot water supply device whose continuous standby time exceeds the second reference time (reference standby time), such hot water supply device is set as the main hot water supply device at the time of the next hot water supply operation and can necessarily most preferentially supply hot water during the next hot water supply operation. Accordingly, since the gas solenoid valves of the hot water supply device whose continuous standby time exceeds the second reference time are necessarily driven to be opened and closed during the next hot water supply operation before being fixed, the gas solenoid valves can be prevented from being fixed.

In addition, in the case where there are multiple hot water supply devices whose continuous standby time exceeds the second reference time, the hot water supply device with the longest continuous standby time among the hot water supply devices is set as the main hot water supply device at the time of the next hot water supply operation and can necessarily most preferentially supply hot water during the next hot water supply operation. Accordingly, the gas solenoid valves of the hot water supply device with the longest continuous standby time are driven to be opened and closed, and the gas solenoid valves can be prevented from being fixed. Moreover, in the auxiliary hot water supply devices whose activation priories are assigned, so that the longer the continuous standby time, the more preferentially the hot water supply device supplies hot water, the solenoid valves are driven to be opened or closed through the additional activation or the fixation prevention operation, so the gas solenoid valves can be prevented from being fixed.

Meanwhile, in the case where there is no hot water supply device whose continuous standby time exceeds the second reference time, the hot water supply device with the shortest cumulative hot water supply operation time is set as the main hot water supply device at the time of the next hot water supply operation and can necessarily supply hot water during the next hot water supply operation. Accordingly, the difference in cumulative hot water supply operation time among the hot water supply devices can be reduced, and the progress of wear and deterioration of the hot water supply devices can be equalized.

Embodiment 2

An example which partially modifies Embodiment 1 will be described. The system control device 15 is substantially the same as that of Embodiment 1. Reference symbols same as those of Embodiment are used, and relevant descriptions are omitted.

Figure 5:
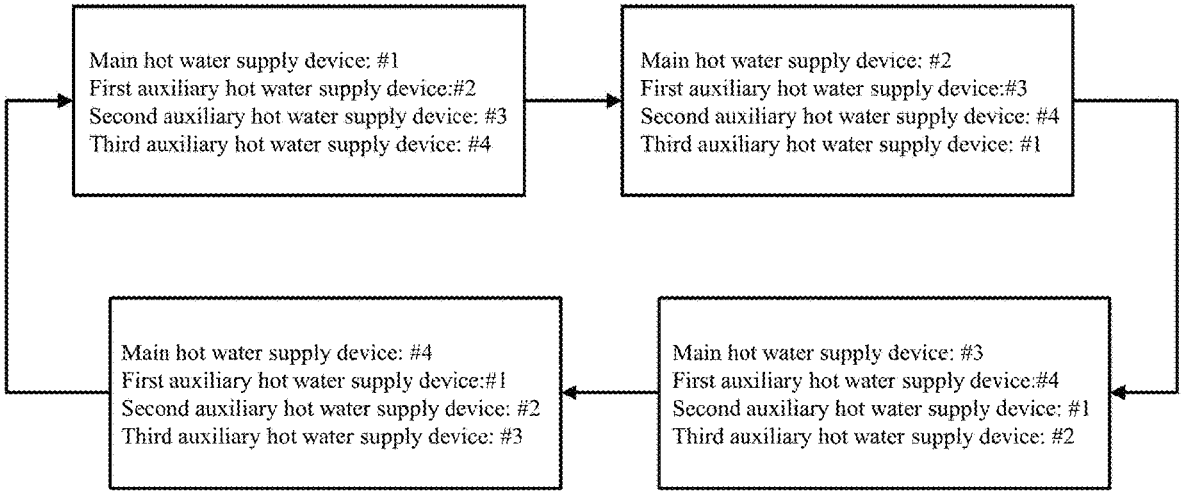
FIG. 5 is a view illustrating a rotation setting according to Embodiment 2.
Figure 6:
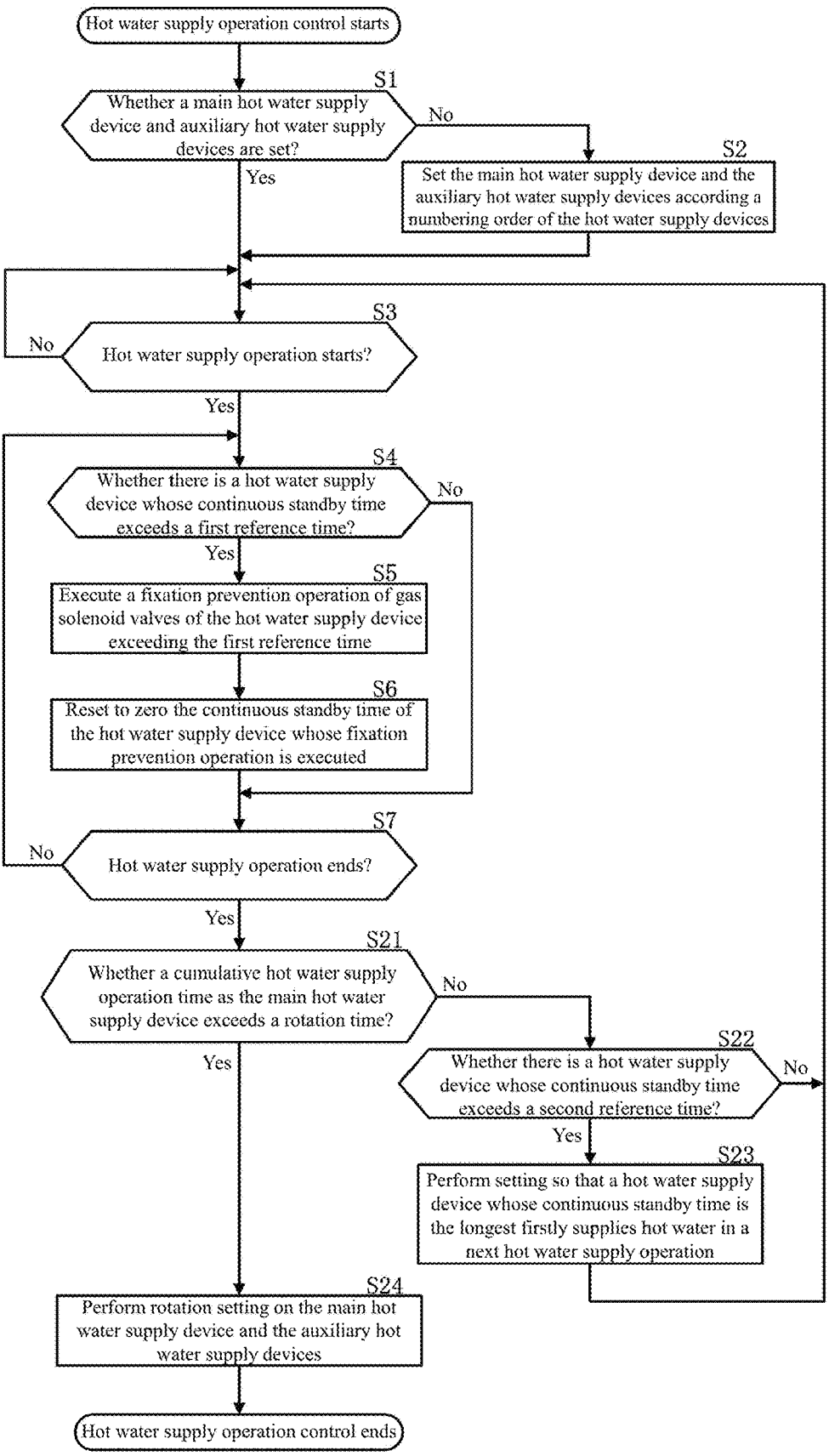
FIG. 6 is a flowchart for hot water supply operation control according to Embodiment 2.

The system control device 15 has the function of timing the cumulative hot water supply operation time and the continuous standby time of each of the hot water supply devices 11 to 14. In the hot water supply operation control, in order to equalize the cumulative hot water supply operation time as the main hot water supply device among the hot water supply devices 11 to 14, the system control device 15 changes the hot water supply device service as the main hot water supply device in order (rotation setting) as shown in FIG. 5. On such basis, control is exerted to prevent the gas solenoid valves of the fuel gas supply part 25 from being fixed based on the continuous standby time. Such hot water supply operation control is described based on the flowchart of FIG. 6.

The system control device 15 starts the hot water supply operation control when the multiple hot water supply system 10 is started, and when the main hot water supply device is changed through the rotation setting, the system control device 15 starts the hot water supply operation control again from the beginning. S1 to S6 after the hot water supply operation control starts are the same as S1 to S6 in FIG. 3 of Embodiment 1. Therefore, the description thereof is omitted.

In S7, whether the hot water supply operation ends is determined. In the case where, for example, the stoppage of the heating operation is received from the control part 36 of the main hot water supply device, the hot water supply operation ends. In the case where the determination of S7 is No, the flow returns to S4 to continue the hot water supply operation. In the case where the determination of S7 is Yes, the flow proceeds to S21.

Next, in S21, whether the cumulative hot water supply operation time as the main hot water supply device since the hot water supply device is set as the main hot water supply device this time exceeds a rotation time set in advance is determined. The rotation time can be selected and set from time determined in advance, such as 24 hours, 12 hours, 8 hours.

In the case where the determination of S21 is No, the flow proceeds to S22. In S22, whether there is a hot water supply device whose continuous standby time exceeds the second reference time (reference standby time) is determined. The second reference time is set to be less than or equal to the first reference time, such as being set to ½ of the duration of the first reference time. In the case where the determination of S22 is No, the flow returns to S3.

Meanwhile, in the case where the determination of S22 is Yes, the flow proceeds to S23. In S23, it is set that the hot water supply device with the longest continuous standby time firstly performs the heating operation and most preferentially supplies hot water at the time of the next hot water supply operation, and the flow returns to S3. In the next hot water supply operation, the hot water supply device with the longest continuous standby time preferentially supplies hot water over the main hot water supply device, and the main hot water supply device is, for example, operated like the auxiliary hot water supply device with the highest operation priority. When the hot water supply operation ends, the priority returns to the priority of the original rotation setting. It may also be set that multiple hot water supply devices whose continuous standby time exceeds the second reference time are preferentially activated in the order of the lengths of the continuous standby time over the main hot water supply device at the time of the next hot water supply operation.

Meanwhile, in the case where the determination of S21 is Yes, the flow proceeds to S24. In S24, rotation setting is performed on the main hot water supply device and the auxiliary hot water supply devices (see FIG. 5) to end the hot water supply operation control and start, from the beginning, the hot water supply operation control for the next hot water supply operation in which the main hot water supply device is changed. The cumulative hot water supply operation time during which the hot water supply devices 11 to 14 serve as the main hot water supply device is equalized, and the priorities during which the hot water supply devices 11 to 14 serve as the auxiliary hot water supply devices are also changed in order. Therefore, the cumulative hot water supply operation time of the hot water supply devices 11 to 14 is approximately the same, and the progress of wear and deterioration of the hot water supply devices 11 to 14 is equalized.

The hot water supply device whose continuous standby time is the longest among the hot water supply devices whose continuous standby time exceeds the second reference time (reference standby time) is set to most preferentially supply hot water in the next hot water supply operation, so such hot water supply device can necessarily perform the heating operation during the next hot water supply operation. Accordingly, since the gas solenoid valves of the hot water supply device whose continuous standby time exceeding the second reference time is the longest are necessarily driven to be opened and closed during the next hot water supply operation before being fixed, the gas solenoid valves can be prevented from being fixed.

The functions and effects of the multiple hot water supply system 10 will be described. The multiple hot water supply system 10 includes the function of calculating the continuous standby time of each of the hot water supply devices 11 to 14, and exerts control so that the hot water supply device whose continuous standby time exceeds the second reference time (reference standby time) set in advance most preferentially supplies hot water during the next hot water supply operation. The hot water supply device whose continuous standby time exceeds the second reference time set in advance can necessarily perform the heating operation during the next hot water supply operation. Therefore, the gas solenoid valves can be driven before being fixed and prevented from being fixed. In addition, in the case where there are multiple hot water supply devices whose continuous standby time exceeds the reference standby time set in advance, the hot water supply device having the longest continuous standby time among the hot water supply devices whose continuous standby time exceeds the reference standby time can necessarily perform the heating operation during the next hot water supply operation. Therefore, the gas solenoids can be driven and prevented from being fixed.

Meanwhile, in the case where control is exerted so that the hot water supply device whose cumulative hot water supply operation time is the shortest most preferentially supplies hot water during the next hot water supply operation when there is no hot water supply device whose continuous standby time exceeds the second reference time, the hot water supply device whose cumulative hot water supply operation time is the shortest necessarily supplies hot water during the next hot water supply operation. Accordingly, the difference in cumulative hot water supply operation time among the hot water supply devices 11 to 14 can be reduced, and the progress of wear and deterioration of the hot water supply devices 11 to 14 can be equalized. Therefore, the service time of the multiple hot water supply system 10 is prevented from being shortened due to the hot water supply device whose wear and deterioration progress.

In addition, those skilled in the art can implement various modifications to the embodiments described above without departing from the spirit of the invention, and the invention includes such modifications.

What is claimed is:

1. A multiple hot water supply system, comprising: a plurality of hot water supply devices; and a control device that increases or decreases an operating device number of a hot water supply operation performed by the hot water supply devices in accordance with a demanded hot water supply capacity, wherein the control device comprises a function of calculating a continuous standby time of each of the hot water supply devices, and, in response to there being a hot water supply device whose continuous standby time exceeds a reference standby time set in advance, the control device exerts control so that the hot water supply device most preferentially supplies hot water during a next hot water supply operation, and wherein the control device comprises a function of calculating a cumulative hot water supply operation time of each of the hot water supply devices, and, in response to there being no hot water supply device whose continuous standby time exceeds the reference standby time, the control device exerts control so that a hot water supply device whose cumulative hot water supply operation time is shortest most preferentially supplies hot water during the next hot water supply operation.

2. The multiple hot water supply system as claimed in claim 1, wherein in response to there being a plurality of hot water supply devices whose continuous standby time exceeds the reference standby time, the control device exerts control so that a hot water supply device having a longest continuous standby time most preferentially supplies hot water during the next hot water supply operation.

3. The multiple hot water supply system as claimed in claim 2, wherein the control device comprises a function of calculating a cumulative hot water supply operation time of each of the hot water supply devices, and, in response to there being no hot water supply device whose continuous standby time exceeds the reference standby time, the control device exerts control so that a hot water supply device whose cumulative hot water supply operation time is shortest most preferentially supplies hot water during the next hot water supply operation.

* * * * *